US005579581A

United States Patent [19]

Melton

[11] Patent Number: 5,579,581

[45] Date of Patent: Dec. 3, 1996

[54] CLIPPER BLADE ASSEMBLY

[75] Inventor: Scott Melton, Erie, Ill.

[73] Assignee: Wahl Clipper Corporation, Sterling, Ill.

[21] Appl. No.: 327,235

[22] Filed: Oct. 21, 1994

[51] Int. Cl.[6] ..... B26B 19/06

[52] U.S. Cl. ..... 30/223; 30/225

[58] Field of Search ..... 30/93.92, 208–211, 30/216–225, 228, 194, 355, 353, 351

[56] References Cited

U.S. PATENT DOCUMENTS

| | | | |
|---|---|---|---|
| 458,940 | 9/1891 | Bonham . | |
| 558,973 | 4/1896 | Milliken . | |
| 560,260 | 5/1896 | Donnelly . | |
| 874,932 | 12/1907 | Brigham . | |
| 1,227,216 | 5/1917 | Tanaka | 30/208 |
| 1,343,175 | 6/1920 | La Fontaine . | |
| 2,102,529 | 12/1937 | Hanley . | |
| 2,107,207 | 2/1938 | Muros . | |
| 2,145,247 | 1/1939 | Casner . | |
| 2,293,637 | 8/1942 | Bourque . | |
| 2,332,557 | 10/1943 | Carillo et al. . | |
| 2,484,610 | 10/1951 | Cromonic . | |
| 2,579,676 | 12/1951 | Kellogg et al. . | |
| 2,702,940 | 3/1955 | Dickerson . | |
| 2,722,742 | 11/1955 | Manifesta . | |
| 3,453,728 | 7/1969 | Loner . | |
| 4,328,616 | 5/1982 | Andis | 30/220 |
| 4,651,761 | 3/1987 | Suen et al. . | |
| 4,765,060 | 8/1988 | Veselaski et al. . | |
| 4,868,988 | 9/1989 | Han . | |
| 4,979,303 | 12/1990 | Han . | |
| 5,068,966 | 12/1991 | Wahl et al. . | |

*Primary Examiner*—Hwei-Siu Payer
*Attorney, Agent, or Firm*—Greer, Burns & Crain, Ltd.

[57] ABSTRACT

A clipper blade for use in a blade assembly of a hair clipper, the blade assembly having a fixed blade and a moving blade reciprocating relative to the fixed blade, the clipper blade includes a web portion having a first edge, and a second edge, a plurality of teeth on at least one of the first and second edges, at least one blade assembly engagement formation being located on the web portion closer to one of the first and second edges than the other of the edges, so that when a pair of blades each having the web portion and the at least one engagement formation are inserted into the blade assembly in reversed opposing relationship to each other, one blade of the pair being the fixed blade edge and having a plurality of teeth on the first edge, and the other blade of the pair being the moving blade and having a plurality of teeth on the second edge, the moving blade is laterally offset relative to the fixed blade.

15 Claims, 2 Drawing Sheets

CLIPPER BLADE ASSEMBLY

RELATED APPLICATION

The present application is related to co-pending application Ser. No. 08/327,436 entitled "DETACHABLE PIVOTING CLIPPER BLADES" filed on Oct. 21, 1994.

BACKGROUND OF THE INVENTION

The present invention relates to blade assemblies for electric hair clippers, and specifically to the construction and arrangement of blades in such assemblies.

Conventionally available electric clippers include two main components: a combined handle and drive system, and a blade assembly which is frequently removable. The blade assembly includes a housing enclosing a fixed blade and a moving blade reciprocating relative to the fixed blade. In some applications, the blade assembly is intended to be disposable, such as when used in clipping patients' hair prior to surgery. Also included in the blade assembly is a cam follower or similar device generally disposed in the housing and configured for engagement with a drive member in the handle portion, which transmits the driving motion generated by the drive member to the moving blade.

Conventional blade assemblies also include a spring or other biasing structure for biasing the moving blade against the fixed blade. Hair cutting takes place through the scissors action of the reciprocating action of the moving blade relative to the fixed blade.

One common disadvantage of conventional clippers occurs through the separate construction of the fixed and moving blades. This occurs largely due to the fact that the construction of the tooth pattern and geometry of the fixed blade is often distinct from those of the moving blade. More specifically, the spacing, tip shape and angle of the teeth often vary between the fixed and moving blades. The presence of multiple blade parts adds to the burden on clipper manufacturers of maintaining inventory and keeping assembly workers supplied with parts on a timely basis. In addition, a greater disparity of component parts often results in a correspondingly more difficult assembly worker training task for the manufacturer.

A further disadvantage of the conventional system of employing separate parts for the fixed and moving blades is that these blades are often produced one-at-a-time in progressive die tooling by stamping machines from rolled steel stock. The high cost of modifying or replacing existing stamping dies has tended to discourage change in this area.

Thus, an object of the present invention is to provide improved fixed and stationary blade elements for use in a clipper blade assembly wherein the fixed and moving blades are provided as a substantially identical single unit which can either be used as a fixed blade or a moving blade.

Another object of the present invention is to incorporate specific geometry of fixed and moving blades into a single blade part so that the desired cutting action and blade orientation of conventional clippers is maintained.

Still another object of the present invention is to provide a blade assembly for use in an electric clipper wherein the fixed and stationary blades are made of substantially identical parts.

SUMMARY OF THE INVENTION

Accordingly, the above-listed objects are met or exceeded by the present blade construction for a clipper blade assembly, wherein a single web has both a fixed blade cutting edge and a moving blade cutting edge. The present blade unit may be positioned in the blade assembly housing as a fixed blade, and a second such unit may be positioned in the housing as the moving blade. The blade unit is specially configured to include the particular structural characteristics of both the fixed and moving blades.

More specifically, the present invention provides a clipper blade for use in a blade assembly of a hair clipper, the blade assembly having a fixed blade and a moving blade reciprocating relative to the fixed blade. The present clipper blade includes a web portion having a first edge, and a second edge, and a plurality of teeth on at least one of the first and second edges. At least one blade assembly engagement formation is located on the web portion closer to one of the first and second edges than the other of the edges, so that when a pair of blades each having said web portion and said at least one engagement formation are inserted into the blade assembly in reversed opposing relationship to each other, one blade of the pair being the fixed blade edge and having a plurality of teeth on said first edge, and the other blade of the pair being the moving blade and having a plurality of teeth on said second edge, the moving blade is laterally offset relative to the fixed blade. In the preferred embodiment, the first cutting edge is configured for application as the fixed blade, the second cutting edge is configured for application as the moving blade, and the blades are substantially identical to each other.

In another embodiment, a blade assembly is provided for use with a hair clipper including a handle with a drive end, a drive member extending from the drive end, and a first coupling formation disposed at the drive end. The blade assembly includes a housing having a second coupling formation configured for engaging the first coupling formation, with the second coupling formation being configured for accommodating the drive member. The housing also has a blade locating formation for locating a fixed blade thereon. Also included in the assembly are a pair of substantially identical cutting blades, each having a web portion having at least one of a first cutting edge and a second cutting edge, the first cutting edge being longer than the second cutting edge, and the first cutting edge being configured for application as the fixed blade, and the second cutting edge being configured for application as the moving blade. One of the blades serves as the fixed blade by employing the first cutting edge, and the other of the blades serves as the moving blade by employing the second cutting edge.

In still another embodiment, a clipper blade is provided for use in a blade assembly of a hair clipper, the blade assembly having a fixed blade and a moving blade reciprocating relative to the fixed blade. The clipper blade includes a web portion having a first edge and a second edge, the second edge being longer than the first edge, a first plurality of teeth on the first edge, and a second plurality of teeth on the second edge. The web portion is vertically offset from at least one of the first and second edges. At least one blade guide slot and at least one blade locating slot are located in the web.

DETAILED DESCRIPTION OF THE PREFERRED EMBODIMENT

Figure 1:
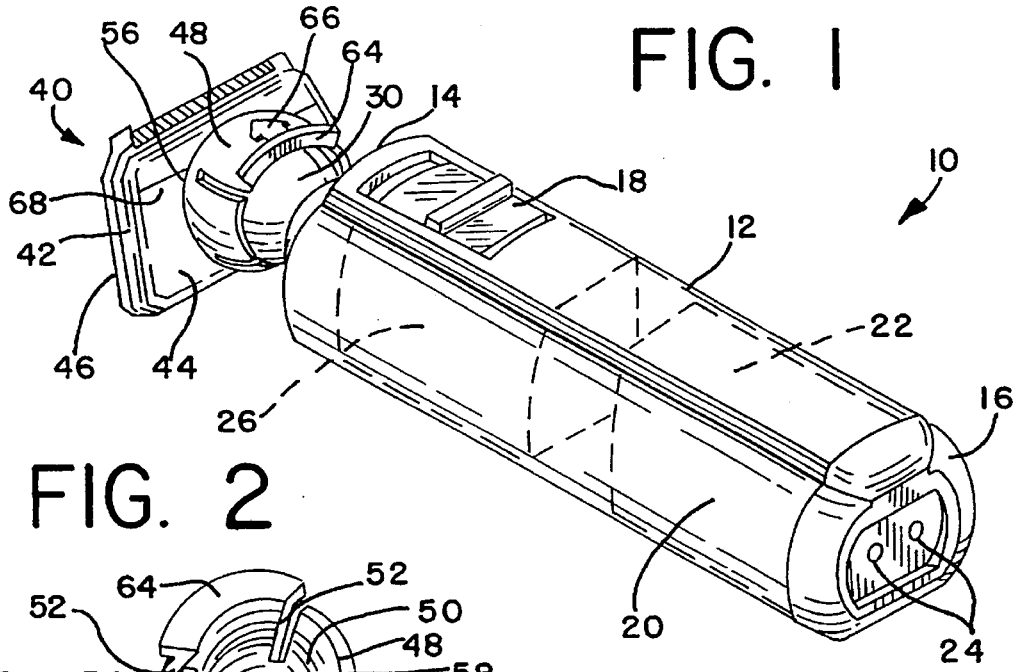
FIG. 1 is a top perspective elevational view of a hair clipper suitable for use with the present blades and blade assembly.
Figure 4:
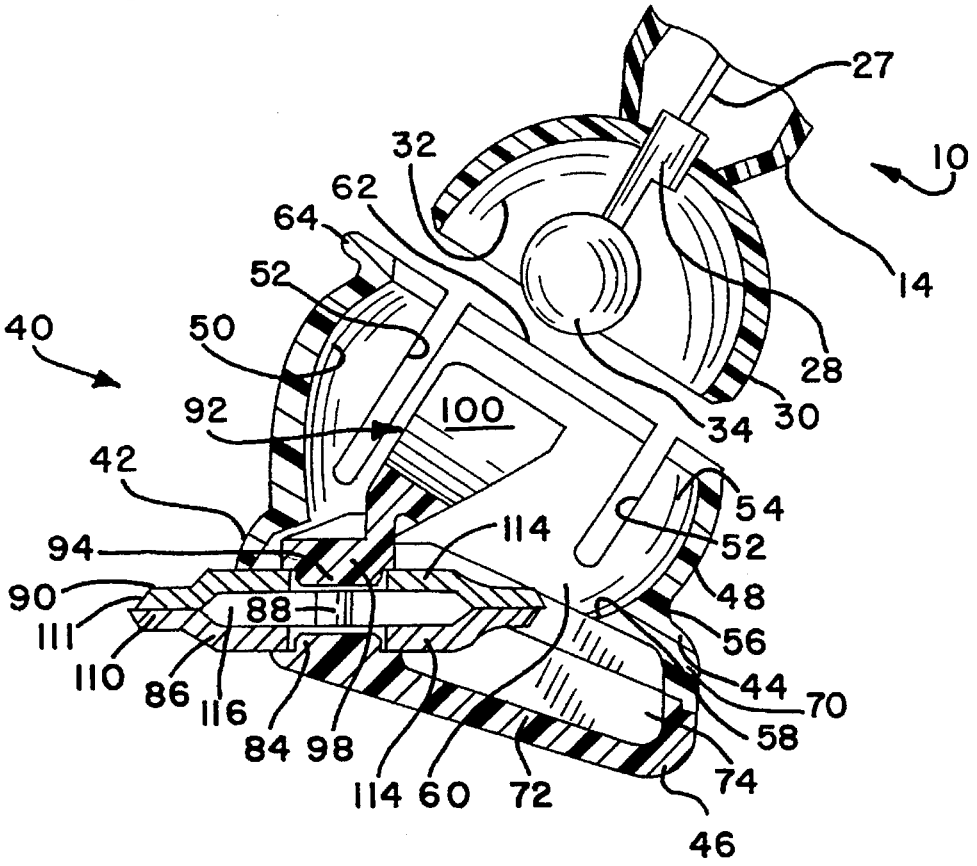
FIG. 4 is a sectional view taken along the line 4—4 of FIG. 3 and in the direction indicated generally, and also including a fragmentary sectional view of the handle portion shown in FIG. 1.

Referring now to FIGS. 1 and 4, an electric hair clipper of the type suitable for use with the present invention is generally designated 10, and includes a motorized handle portion 12 having a drive end 14, a recharge end 16 opposite the drive end, and a switch 18 located therebetween. More specifically, the handle portion 12 includes a housing 20 preferably made of durable, impact-resistant, molded polymeric material as is known in the art. Enclosed by the housing 20 is a battery 22 (shown hidden), which in the preferred embodiment is rechargeable, however disposable batteries or the use of A.C. power are also contemplated. Terminals 24 for engaging a recharging stand (not shown) are located at the recharge end 16.

Connected to the battery 22 in a known manner is an electric motor 26 (shown hidden) which is secured within the housing 20, is electrically connected to the switch 18, and which has a drive shaft or armature 27 (best seen in FIG. 4) secured to an offset cam eccentric 28 (best seen in FIG. 4). The arrangement and operation of the motor 26, the battery 22, and the cam eccentric 28 are similar to components which are well known in the art and are described in detail in commonly assigned U.S. Pat. No. 5,068,966, which is incorporated by reference herein.

At the drive end 14 is provided a first coupler formation 30 which is frusto-spherical or bowl-like in shape and defines a central cavity 32 (best seen in FIG. 4) into which projects the cam eccentric 28 and a lobe or spherically shaped drive actuator member 34. The actuator member 34 is preferably fixed upon the cam eccentric 28. In fact, the actuator member 34 and the cam eccentric 28 may be machined as a single piece, and it is contemplated that any equivalent method of attaching a ball to orbit about the centerline of a motor shaft may be suitably employed.

Referring now to FIGS. 1–4, included with the clipper 10 is a blade assembly, generally designated 40, which is made up of a blade assembly housing 42 preferably having a first housing portion 44 and a second housing portion 46. The first housing portion 44 includes a shroud or swivel formation 48 which is also generally frusto-spherical or bowl shaped and defines a central recess 50. The formation 48 defines a socket dimensioned to accommodate the first coupler formation 30, is preferably dimensioned to encompass and accommodate the first coupler formation in a ball-and-socket connection, and as such is also referred to as a second coupler formation. Upon engagement of the first and second coupler formations 30, 48, the blade assembly 40 is rotatable a full 360° about the first coupler formation 30, and is also preferably pivotable relative to the drive end 14, in the range of 30° in the embodiment described. Either of the first and second coupler formations 30,48 may be located on either the blade assembly 40 or the drive end 14.

In the preferred embodiment, the swivel formation 48 is provided with a biasing force with which it grips the first coupler formation 30, and which may be overcome when the blade assembly 40 is disengaged from the coupler formation 30 of the handle portion 12. Such biasing force is provided by at least one and preferably four notches 52 defining the swivel formation 48 into multiple spring-biased tabs 54. To facilitate both the pivoting action of the swivel formation 48 relative to the coupler formation 30, the formation 48 is preferably made of a relatively more resilient plastic material, or is constructed to have a lower spring rate, while the formation 30 is more rigid either through material selection or component construction as is known in the art. It is also contemplated that the relative flexibility of the formations 48 and 30 may be reversed.

Figure 3:
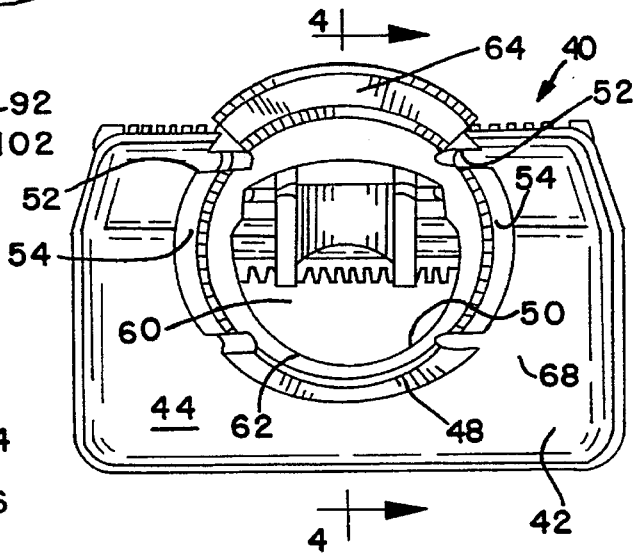
FIG. 3 is a rear end view of the blade assembly depicted in FIG. 2.

At a base end 56 of the swivel formation 48 is defined an opening 58 which is in communication with an interior housing chamber 60 (best seen in FIG. 3). Opposite the base end 56, the swivel formation includes an annular rim 62 and preferably at least one radially extending release tab 64 integrally joined to said rim. In the preferred embodiment, the release tab 64 is constructed and arranged to be large enough to be engaged by an operator's thumb. A pushing force exerted in the direction indicated by an arrow 66 (best seen in FIG. 1) will disengage the blade assembly 40 from the handle portion 12. An added feature is that the arrow 66 is integrally molded onto the swivel formation 48 to serve as a permanent indicator. Aside from the swivel formation 48, the first housing portion 44 includes an upper surface 68 to which the swivel formation is attached, and a depending skirt 70.

The second housing portion 46 has a substantially planar floor 72 with an upstanding peripheral wall 74 on three sides, 76, 78 and 80. The peripheral wall 74 is constructed and arranged to be fixed to opposing portions of the depending skirt 70 using chemical adhesive, ultrasonic or RF welding, or other suitable attachment technologies. A feature of the present blade assembly 40 is that the floor 72 has a lower outer surface with a significant surface area with which to contact the subject's skin and/or to contact a hair comb, depending on the application. In this manner, guidance is provided to the operator for hair clipping purposes.

Figure 2:
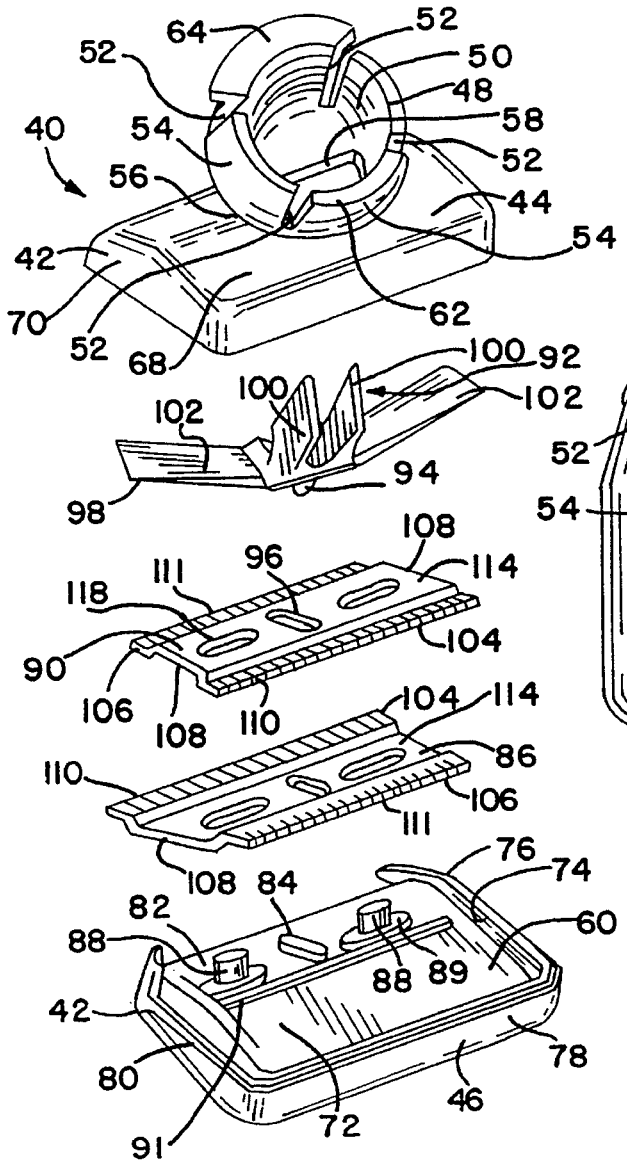
FIG. 2 is an exploded perspective view of the present detachable clipper blade assembly.

Referring now to FIG. 2, the floor 72 is generally inclined toward an open side 82 and is provided with a blade locating lug 84 which is preferably integrally formed with the floor 72. The lug 84 is preferably elongate in shape and has a longitudinal axis which is generally parallel to the sides 76 and 80. Further, the lug 84 has a height preferably designed to be slightly taller than the cross-sectional thickness of a fixed blade 86 to maintain the blade in a fixed position on the floor 72. It is also contemplated that the lug 84 may be slightly shorter than the blade thickness, as long as the blade 86 is prevented from moving.

Adjacent each side of the lug 84 is disposed a blade guide boss 88 which is integrally formed or otherwise secured to the floor 72 for guiding a reciprocating or moving blade 90 relative to the fixed blade 86. The blade guide bosses 88 also each have a broad-shaped base 89 which aids in supporting and securing the fixed blade 86 in position on the floor 72. In the preferred embodiment, the blade guide bosses 88 are each preferably oriented at a 90° angle to the blade locating lug 84, and preferably have a relatively equal or greater height for engaging the moving blade 90 as will be described below. It is also preferred that the floor 72 be provided with a support rib 91 which projects vertically from the floor to support an underside of the fixed blade 86.

In addition to the first and second housing portions 44, 46, and the fixed and reciprocating blades 86, 90, the blade assembly 40 further includes a cam follower, generally designated 92, for engaging the drive actuator member 34 in the central recess 50 in the swivel formation 48. The orbital eccentric motion of the drive actuator member 34 is translated into reciprocating linear action at the reciprocating blade 90 by a blade driver lug 94 (best seen in FIG. 4) which extends from the cam follower 92 and engages a central slot 96 on the blade 90. The lug 94 is preferably dimensioned to be tall enough to maintain engagement with the slot 96, without interfering with the upper end of the blade locating lug 84.

Another function of the cam follower 92 is to exert a biasing force on the fixed and reciprocating cutting blades 86, 90. Such a biasing force urges the reciprocating blade 90 against the fixed blade 86.

Referring now to FIGS. 2–4, the cam follower 92 preferably consists of a single integrally formed piece, fabricated by injection molding or equivalent technology. A generally rectangular and flattened base 98 serves on an upper side as the attachment point for a cam follower formation 100. In shape, the formation 100 may be generally forked or U-shaped to fit snugly onto the spherical drive actuator member 34. Thus, the formation 100 is configured to be driven by the actuator member 34 and still permit a wide range of rotational and pivotal motion of the head assembly 40 without interfering with the driving action. An important feature of the head assembly 40 is that it is rotatable 360° relative to the coupler end and is also pivotable approximately 30° from a base position as shown in FIG. 1.

A result of the engagement of the forked cam follower 100 on the spherical drive actuator member 34 is that the driving lug 94 is maintained at a constant diametrical distance from the member 34 throughout a wide range of motion, regardless of the orientation of the head assembly 40 to the coupler assembly 30. This engagement is important for achieving the rotatability of the head assembly 40 relative to the coupler formation 30. The formation 100 also is long enough to project through the opening 58 and into the recess 50 defined by the swivel formation 48. The cam follower formation 100 is generally opposite the location on the base 98 from which depends the blade driver lug 94.

Located laterally adjacent each side of the cam follower formation 100 on the base 98 is an integrally formed, resilient, upwardly or vertically inclined wing formation 102. The wings 102 are constructed to resist a downwardly directed vertical force, and thus exert a biasing force on the base 98 near the driver lug 94. As such, when the cam follower 92 is assembled into the housing 42, the wings 102 will engage the underside of the upper surface 68 of the first housing portion 44, and accordingly will cause the base 98 to exert a biasing force against the uppermost reciprocating blade 90. The reciprocating blade 90 will slidingly engage the fixed blade 86, and the blades 86, 90 will thus be biased against each other and the floor 72.

Figure 5:
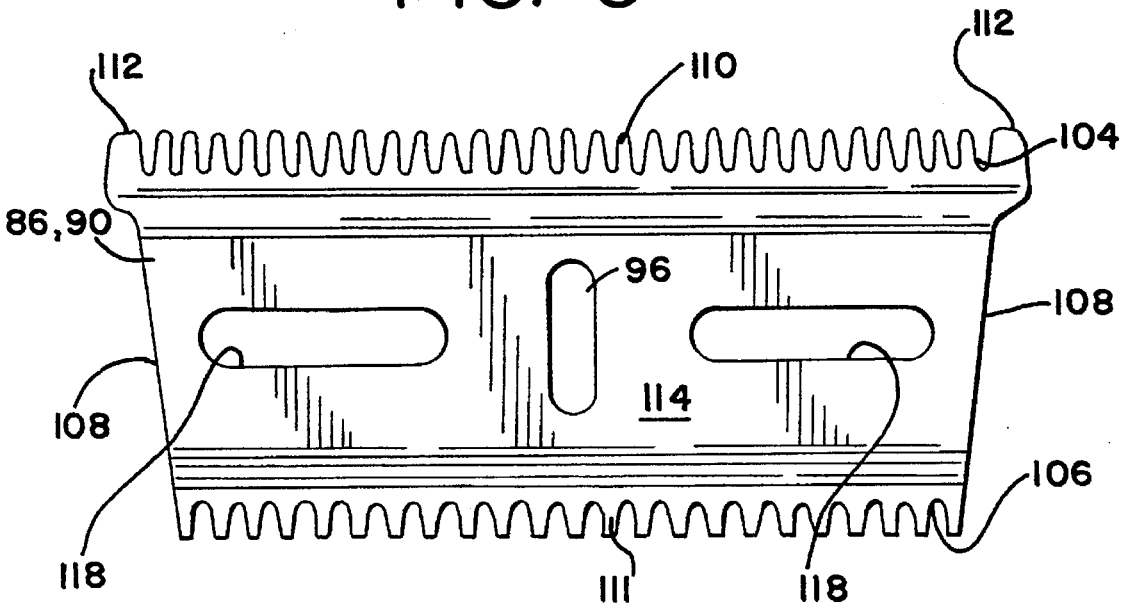
FIG. 5 is an overhead plan view of the present clipper blade.

Referring now to FIGS. 2, 4 and 5, the blades 86, 90 will be described in greater detail. A principal feature of the present invention is that although the blades 86, 90 have been designated as separate components and have different functions in the assembly 40, they may be identical in construction. In other words, depending on the finishing operations employed, the same component may either be used as a fixed blade 86, or as a movable blade 90. Each blade 86, 90 has a wide edge 104, a narrow edge 106, and a pair of angled sides 108. Each edge 104, 106 preferably serves as a cutting edge, with the edge 104 serving as the fixed edge, and the edge 106 as the moving or reciprocating edge. The blades are preferably stamped from stainless steel to prevent corrosion.

Each of the wide and narrow edges 104, 106 has a respective plurality of teeth 110, 111. Generally, differences in tooth shape and spacing of the teeth 110, 111 provide a more efficient cutting action than when identical tooth patterns are used for both blades 86, 90. More specifically, the teeth 110 on the wide edge are rounded or radiused at their tips to avoid nicking or cutting the subject. Conversely, the tips of the teeth 111 on the narrow edge are truncated or cut off to provide sharper corners for cutting. Further, in the present embodiment, the teeth 111 are spaced farther apart and the side cutting edges have a greater rake angle than the teeth 110. It should be noted that, based on application of the product and manufacturing requirements, either or both of the relative rake angle and spacing of the teeth may vary. It will be seen that the wide edge 104 has a wider outside tooth 112 at each end thereof. These outside teeth 112 allow more protection against cutting and nicking of the skin by the edge 106.

On each blade 86, 90 a central web portion 114 is vertically offset from the edges 104, 106, so that when the blades 86, 90 are placed upon each other in opposing operational relationship in the housing 42, as seen in FIG. 4, a space 116 is defined therebetween. This construction is desirable to minimize the friction between the blades 86, 90 during operation by localizing the opposing contact areas of the blades to the region along the edges. On the web portion 114 is found the centrally located slot 96, as well as an elongate guide slot 118 on each side of the central slot. Each guide slot 118, also termed an engagement formation, is dimensioned to slidingly accommodate one of the blade guide bosses 88, and is long enough to accommodate the reciprocal stroke of the reciprocating blade 90. The length of the stroke is determined by the dimensions of the eccentric member 28, as is known in the art. The slots 118 are parallel to the narrow and wide edges 104, 106.

Referring now to FIG. 4, it will be seen that the reciprocating blade 90 is slightly offset laterally away from the fixed blade 86. This relative position of the blades is intended to prevent nicking and/or cutting the skin of the person whose hair is being clipped. The offset relationship is provided by placing the guide slots 118 slightly closer to the narrow edge 106 than to the wide edge 104. In a preferred embodiment, the guide slots 118 are on the order of 0.012 inch closer to the narrow edge 106.

In other words, given a centerline of the blades 86, 90 taken parallel to the edges 104, 106, the guide slots 118 are offset from the centerline. A function of this offset construction is when an offset distance X is desired between the fixed and moving blades 86, 90, and the blades are identical in configuration, the offset of the guide slots 118 from the center line is 0.5×.

In operation, the blade assembly 40 is assembled by placing a fixed blade 86 upon the blade locator lug 84 and upon the base 89 on the floor 72 so that the teeth 110 extend out the open side 82. At this time, the top of the blade guide bosses 88 will extend through the guide slots 118, but provide no guidance since the blade is fixed. The bosses 88 guide the reciprocating blade 90 relative to the fixed blade 86. The reciprocating blade 90 is placed upon the taller guide bosses 88 so that its narrower edge 106 extends out the open side 82, and is inverted relative to the fixed blade 86 so that the space 116 is formed between the two blades. However, the opposing toothed edges 104 and 106 will be in sliding contact with each other (best seen in FIG. 4). Although the guide bosses 88 engage the guide slots 118, the blade locator lug 84 does not engage the reciprocating blade 90. Thus, when identical parts are used for both the fixed and moving blades 86, 90, one blade is flipped over and reversed front-to-back relative to the other blade.

Next, the cam follower 92 is disposed upon the reciprocating blade 90 so that the blade driver lug 94 is inserted into the central slot 96. The lug 94, as is the locator lug 84, is dimensioned to be tightly accommodated in the central slot 96 to prevent unwanted play in the blades 86, 90. The driver lug 94 does not engage the fixed blade 86. As the uppermost first housing portion 44 is lowered upon the reciprocating blade 90, the cam follower formation 100 passes through the opening 58 and extends into the central recess 50 of the swivel formation 48. Once the first housing portion 44 is fastened to the lowermost second housing portion 46, the engagement of the resilient wings 102 against the first housing portion 44 will exert a biasing force against the reciprocating blade 90 to hold that blade against the fixed blade 86, and also hold the fixed blade against the floor 72 of the second housing portion 46. As seen in FIG. 4, the blades 86, 90 are only partially enclosed by the housing 42 and project from the open side 82 to engage hair to be clipped.

Attachment of the blade assembly 40 to the handle portion 12 proceeds by engaging the swivel portion 48 about the first coupler 30 portion of the handle portion. The clamping tabs 54 are spread slightly to accommodate the insertion of the first coupler portion, but then retract over the drive end 14 to secure the components together.

At the same time, the forks of the cam follower formation 100 snugly fit onto the drive actuator member 34. Upon assembly, the blade assembly 40 has 360° of rotational movement and substantial pivotal movement in the range of 30°, and is able to be positioned by an operator or technician in a wide variety of angular orientations to facilitate clipping. Also, the eccentric rotation of the drive actuator member 34 is translated by the cam follower 100 into the linear reciprocating movement of the blade 90 relative to the blade 86 regardless of the angular orientation of the blade assembly to the handle portion 12.

A significant advantage of the construction of the clamping tabs 54 and the cam follower 100 is that the operator may readily align and attach the blade assembly 40 upon the handle portion 12 by merely exerting an axially directed pushing force upon the blade assembly towards the handle portion. Unlike conventional designs, there is no special alignment or manipulation required to achieve proper engagement of the blade assembly upon the handle, and engagement of the cam follower may be accomplished in a single operation.

Upon completion of the clipping operation, the operator or technician may place the clipper 10 near a disposal container. The tab 64 is pressed by the operator's thumb or finger in the direction of the indicator arrow 66, and the entire blade assembly 40 will pop off into the disposal container without requiring the operator to come in contact with the sharp blades and may easily be accomplished using only the same hand holding the unit. Prior art clippers with detachable heads require two hands or the touching of blades by the operator, which may expose the operator to contamination.

While a particular embodiment of the clipper blade assembly of the invention has been shown and described, it will be appreciated by those skilled in the art that changes and modifications may be made thereto without departing from the invention in its broader aspects and as set forth in the following claims.

What is claimed is:

1. A blade assembly for use with a hair clipper, the clipper including a handle with a drive end, a drive member extending from the drive end, and a first coupling formation disposed at the drive end, said blade assembly comprising:

a housing having a fixed blade and a moving blade reciprocating relative to said fixed blade, a second coupling formation configured for engaging the first coupling formation, said second coupling formation being configured for accommodating the drive member, said housing also having blade locating means for locating said fixed blade thereon;

said blades being substantially identical, each said blade configured for use as either of said fixed blade and said moving blade, each said blade having a web portion, a first cutting edge and a second cutting edge, said first cutting edge being longer than said second cutting edge, said web portion further including a pair of longitudinal guide slots extending substantially parallel with said cutting edges, said guide slots being disposed closer to said second cutting edge than to said first cutting edge; and said first cutting edge being configured for application as the fixed blade, and said second cutting edge being configured for application as the moving blade, wherein one of said pair of blades serves as said moving blade by employing said second cutting edge, and the other of said blades serves as said fixed blade by employing said first cutting edge.

2. A blade assembly for use with a hair clipper, the clipper including a handle with a drive end, a drive member extending from the drive end, and a first coupling formation disposed at the drive end, said blade assembly comprising:

a housing having a fixed blade and a moving blade reciprocating relative to said fixed blade, a second coupling formation configured for engaging the first coupling formation, said second coupling formation being configured for accommodating the drive member, said housing also having blade locating means for locating said fixed blade thereon;

said blades being substantially identical, each said blade configured for use as either of said fixed blade and said moving blade, each said blade having a web portion, a first cutting edge and a second cutting edge, said first cutting edge being longer than said second cutting edge; and said first cutting edge being configured for application as the fixed blade, and said second cutting edge being configured for application as the moving blade, wherein one of said blades serves as said moving blade by employing said second cutting edge, and the other of said blades serves as said fixed blade by employing said first cutting edge.

3. The blade assembly as defined in claim 2 wherein said blades are laterally offset relative to each other.

4. The blade assembly as defined in claim 2 wherein said web portion of each of said blades includes at least one guide slot and at least one locating slot.

5. The blade assembly as defined in claim 2 wherein said web portion includes a pair of longitudinal guide slots extending substantially parallel with said cutting edges, said guide slots being disposed closer to said second cutting edge than to said first cutting edge.

6. The blade assembly as defined in claim 2 wherein said blades are identical to each other.

7. A pair of clipper blades for use in a blade assembly of a hair clipper, the blade assembly having a fixed blade and a moving blade reciprocating relative to the fixed blade, each of said clipper blades being configured for use as either of said fixed blade and said moving blade, each said clipper blade comprising:

a first edge and a second edge;

a web portion disposed between said first edge and said second edge;

a plurality of cutting teeth on each of said edges;

at least one blade assembly engagement formation being located on said web portion closer to one of said edges than the other of said edges, so that when said clipper blades, each having said web portion and said at least one engagement formation are inserted into the blade assembly in reversed opposing relationship to each other, one of said blades being the fixed blade and having a first plurality of cutting teeth, and the other of said blades being the moving blade and having a second plurality of cutting teeth, the moving blade is laterally offset relative to the fixed blade.

8. The clipper blades as defined in claim 7 wherein said first edge is longer than said second edge.

9. The clipper blades as defined in claim 7 further including at least one central slot in each said blade for accommodating a blade driving formation.

10. The clipper blades as defined in claim 7 wherein said blade assembly engagement formation includes at least one guide slot disposed in said web portion.

11. The clipper blades as defined in claim 7 wherein said blade assembly engagement formation includes a pair of longitudinal guide slots extending substantially parallel with said edges, said guide slots being disposed closer to said second edge than to said first edge.

12. The clipper blades as defined in claim 7 wherein at least one of said edges are vertically offset from said web portion.

13. The clipper blades as defined in claim 7 wherein said first plurality of cutting teeth have rounded tips, and said second plurality of cutting teeth have truncated tips.

14. A clipper blade for use in a blade assembly of a hair clipper, the blade assembly having a fixed blade and a moving blade reciprocating relative to the fixed blade, said clipper blade comprising:

a first edge and a second edge, said second edge being longer than said first edge;

a web portion disposed between said first edge and said second edge;

a first plurality of teeth on said first edge; and a second plurality of teeth on said second edge;

said web portion being vertically offset from at least one of said first and second edges;

at least one blade guide slot in said web portion; and at least one blade locating slot in said web portion.

15. The clipper blade as defined in claim 14 wherein said at least one blade guide slot and said at least one blade locating slot are located on said web portion closer to one of said edges than the other of said edges, so that when said clipper blade is combined with another such blade to form a pair of blades, and said blades are inserted into the blade assembly in reversed opposing relationship to each other, one blade of said pair being the fixed blade, and the other blade of said pair being the moving blade, the moving blade is laterally offset relative to the fixed blade.

* * * * *